United States Patent [19]

Stout

[11] Patent Number: 4,658,900

[45] Date of Patent: Apr. 21, 1987

[54] HIGH ENERGY FIRING HEAD FOR WELL PERFORATING GUNS

[75] Inventor: Gregg W. Stout, Montgomery, Tex.

[73] Assignee: Baker Oil Tools, Inc., Orange, Calif.

[21] Appl. No.: 742,096

[22] Filed: Jun. 6, 1985

[51] Int. Cl.[4] ..... F21B 43/116

[52] U.S. Cl. ..... 166/297; 166/55; 175/4.56; 89/1.15

[58] Field of Search ..... 166/297, 299, 55, 55.1, 166/55.2, 63; 175/2, 3, 4.5, 4.55, 4.56, 4.57, 4.6; 102/320, 322, 204, 318, 306; 89/1.15

[56] References Cited

U.S. PATENT DOCUMENTS

| | | | |
|---|---|---|---|
| 3,415,192 | 12/1968 | Stradler et al. | 102/322 X |
| 3,638,572 | 2/1972 | Menichelli | 102/204 X |
| 4,191,265 | 3/1980 | Bosse-Platiere | 175/4.6 X |
| 4,421,030 | 12/1983 | Dekoker | 102/204 X |
| 4,441,427 | 4/1984 | Barrett | 102/204 X |
| 4,491,185 | 1/1985 | McClure | 175/4.56 |
| 4,512,418 | 4/1985 | Regalbuto et al. | 102/322 X |
| 4,523,649 | 6/1985 | Stout | 175/4.51 |

*Primary Examiner*—Stephen J. Novosad
*Assistant Examiner*—David J. Bagnell
*Attorney, Agent, or Firm*—Norvell & Associates

[57] ABSTRACT

A high energy firing mechanism for a well perforating gun comprises a downwardly directed shaped charge which is discharged by an impact detonatable primer. The explosive jet developed by the downwardly directed shaped charge impinges upon a booster charge which in turn is connected to a primer cord leading to the shaped charges of a perforating gun. Sufficient detonating energy is produced to assure high energy detonation of the booster charge and primer cord, even though such elements may be formed from a thermal resistant explosive.

9 Claims, 2 Drawing Figures

HIGH ENERGY FIRING HEAD FOR WELL PERFORATING GUNS

BACKGROUND OF THE INVENTION

1. Field of the Invention

The invention relates to a firing mechanism for a subterranean well perforating gun, and particularly to a firing mechanism of generating high detonating energy.

2. History of the Prior Art

The perforation of a well casing and the adjacent production formation is a procedure employed in practically all subterranean oil and gas wells. In the completion of wells of substantial depth, it has become a common practice to employ a perforating gun that is run into the well on the bottom of a tubing string. A packer is incorporated in the tubing string and is set in the well casing so as to position the perforating gun adjacent the production formation. This practice has the advantage of permitting a much larger perforating gun to be employed than is possible if the gun were run into the well through a tubing string on a wireline. More importantly, it permits the perforating of the well in the so-called "underbalanced" condition wherein the fluid pressure existing in the tubing string adjacent the formation is substantially less than the anticipated fluid pressure of the production formation after the perforating operation is completed. This permits a relatively high velocity flow of production fluid from the newly formed perforations in the production formation thus flushing the perforations of the debris that is commonly associated with a perforating operation.

One negative factor encountered in mounting of a perforating gun on the bottom of a tubing string is the high cost involved in replacing the gun in the event the gun fails to fire. The failure of perforating guns to fire is particularly prevalent when the production formation involves ambient temperatures of 400° F. or higher and wherein the perforating gun and its firing head must be exposed to such temperatures for relatively long time periods, such as a hundred hours or more, while other operations are being performed in the upper portions of the well or at the well head. In the first place, very few explosives commonly used in perforating guns are capable of maintaining thermal stability at such temperatures and for such a long period of time. This problem may be cured, however, by utilizing a different type of explosive, hereinafter called a thermal resistant explosive, as the explosive element of the shaped charges normally employed in a perforating gun.

The utilization of such thermal resistant shaped charges immediately raises another problem, namely, such thermal resistant shaped charges require very high detonating energy in order to effect their detonation. The detonating energy produced by an impact detonatable primer, generally comprising lead azide as the explosive element, is not sufficient to institute the high energy detonation of a booster charge or primer cord formed of thermally stable explosives. Hence, the primer may fire, but the booster charge and/or primer cord leading to the shaped charges of the perforating gun will not be detonated or, if detonated, the level of detonating energy will be too low to effect the detonation of the shaped charges of a thermal resistant explosive.

SUMMARY OF THE INVENTION

The invention contemplates providing a firing mechanism for a perforating gun capable of producing much higher levels of detonating energy than has heretofore been utilized. While the principles of this invention are particularly applicable to the problem of detonating thermal resistant explosive charges of a well perforating gun, the invention may be utilized to more reliably effect the detonation of shaped charges formed of conventional explosive material. In any event, a preferred embodiment of the invention contemplates forming the shaped charges of the perforating gun from a thermal resistant material capable of maintaining thermal stability at temperatures of 400° F. or more for a period in excess of one hundred hours. A primer cord formed of a thermally stable material and preferably encased in a relatively rigid casing, such as aluminum, is positioned adjacent the detonating ends of each of the shaped charges and extends upwardly to a booster charge chamber where it is secured to a booster charge. The explosive materials of both the primer cord and the booster charge constitute thermally resistant explosives similar to those utilized in the shaped charges. Immediately above the booster charge, a downwardly directed shaped charge is mounted, and again, the explosive employed in such shaped charge is a thermal resistant explosive.

Immediately above the downwardly directed shaped charge, an impact detonatable primer is mounted. Such primer is preferably of the "flyer plate" design commonly known in the well completing industry and characterized by the fact that it discharges, at high velocity, a small disc of metal with a speed high enough to effect the detonation of the downwardly directed shaped charge. The detonating energy developed by the shaped charge in turn is sufficiently high so as to insure the detonation of the booster charge and the primer cord at a high detonating energy level, thus assuring the discharge of the shaped charges located in the perforating gun and formed of the thermal resistant explosive material.

In an alternative embodiment, the detonatable primer is incorporated in the shell or housing containing the downwardly directed shaped charge.

Further advantages of the invention will be readily apparent to those skilled in the art from the following detailed description, taken in conjunction with the annexed sheets of drawings on which are shown two preferred embodiments of the invention.

DESCRIPTION OF THE PREFERRED EMBODIMENTS

Figure 1:
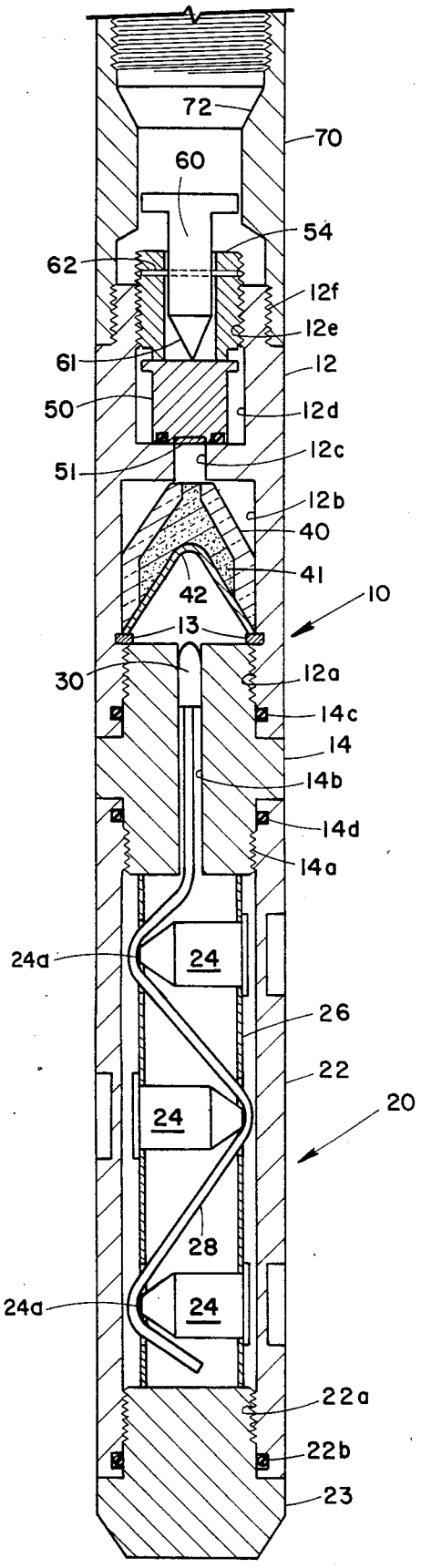
FIG. 1 is a schematic, vertical sectional view of a perforating gun incorporating a high energy detonating mechanism embodying this invention.

A firing mechanism 10 embodying this invention is incorporated within a hollow housing 12 which is secured by internal threads 12*a* to the upper end of a connecting sub 14. The lower end of connecting sub 14 is provided with external threads 14*a* for securement to the tubular housing 22 of a perforating gun 20. The lower end of gun housing 22 is provided with internal threads 22*a* and a bull plug 23 is secured to such threads.

Alternatively, a connector element similar to the connector 14 may be secured to such threads for mounting thereon of one or more additional perforating gun sections.

Within the perforating gun housing 22, a plurality of shaped charge containers 24 are mounted in vertically and angularly spaced relationship in a charge holder strip 26 which is of polygonal configuration. For example, the shaped charge containers may be mounted in the manner described in my co-pending application Ser. No. 432,481, filed Oct. 4, 1982, and assigned to the assignee of the instant application.

A primer cord 28 is mounted adjacent the detonating ends 24*a* of each of the shaped charge containers 24 and extends upwardly through the hollow bore 14*b* of the connector 14 where it terminates in a booster charge 30. Primer cord 28 is preferably encased in a metallic tubing, such as aluminum, or a relatively rigid plastic to maintain the integrity of the explosive material under high thermal conditions.

While this invention is not limited thereto, the shaped charge containers 24, the primer cord 28 and the booster charge 30 all preferably utilize a thermal resistant explosive material capable of withstanding temperatures in excess of 400° F. for a period in excess of one hundred hours. Examples of such thermal resistant explosives is the explosive material hexanitrostilbene, and [2,6-bis(picrylamino) -3,5-dinitropyridine]. Such explosives are sold under the trademarks HNS and PYX respectively by the Ensign-Bickford Company of Simsbury, Conn. Such explosives are characterized by requiring a very high level of detonating energy to be applied thereto in order to effect their detonation.

The housing assembly 12 comprises a downwardly facing chamber 12*b* within which is mounted a downwardly facing shaped charge 40. Shaped charge 40 is secured within chamber 12*b* by a retaining ring 13. Such shaped charge is also preferably formed from one of the aforementioned thermal resistant explosives. Additionally, the shaped charge 40 incorporates a metallic liner element 42 covering its downwardly facing end to provide more mass for the high velocity jet produced by the discharge of the shaped charge explosive 41.

The housing assembly 12 defines an upwardly facing primer chamber 12*d* and a detonatable primer 50 is mounted within the primer chamber 12*d*. Detonatable primer 50 is preferably of the "flyer plate" design which is manufactured by the Teledyne McCormick Selph of Hollister, Calif. and is characterized by the downward discharge at high velocity of a thin metal disc 51 incorporated in the detonatable primer.

Primer 50 is secured within the primer chamber 12*d* by a hammer mounting sleeve 54 which is secured to internal threads 2*e* formed in the top portion of the housing 12. A hammer 60 having a pointed end 61 is mounted for sliding movements within the bore of a hammer sleeve 54 and is normally retained in an elevated position with respect to the primer 50 by shear pin 62. Hammer 60 is driven downwardly into impact engagement with the detonatable primer 50 by the dropping of a detonating bar through the tubing string to which the firing mechanism housing 12 is connected. A guide sleeve 70 may be threadably secured to external threads 12*f* provided on the top end of the firing housing 12 and defines internally projecting sloped surfaces 72 to function as a guide for the free falling detonating bar in order to direct it into engagement with the top portion of the hammer 60.

The operation of the high energy firing mechanism embodying this invention will be readily apparent to those skilled in the art from the foregoing description. Upon the dropping of the detonating bar and the detonation of the primer 50 by the hammer 60, the flying disc 51 of the detonatable primer 50 is driven downwardly at high velocity to impact against the detonation end of the downwardly directed shaped charge 40, thus effecting the high energy detonation of its charge even though the explosive contained in the charge may be of the thermal resistant type. The discharge of the shaped charge 40 produces a high energy downwardly directed jet of gas and metal particles which impinge upon the booster charge 30, thus detonating such booster charge and detonating the primer cord 28. In fact, the energy developed by the downwardly directed shaped charge 40 is sufficiently high that, in some instances, the booster charge 30 may be eliminated and direct detonation of the top end of the primer cord 28 may be obtained by the discharge of the downwardly directed shaped charge 40. In any event, the high energy detonation of the primer cord 28 will assure the detonation of the shaped charges 24 and the firing of the entire gun section or sections may be accomplished with a reasonable degree of assurance, even though the explosive elements of such gun may have been exposed to high temperatures for long periods of time.

It is also possible to utilize the separable firing mechanism disclosed in my co-pending application Ser. No. 742,097, filed concurrently herewith, now U.S. Pat. No. 4,611,660. With a mechanism of this type, wherein a portion of the firing mechanism is run into the well with the perforating gun, the remaining portion, including the detonatable primer is subsequently run into the well on wireline and latched to the previously run-in portions of the firing mechanism. With such procedure, the risk that the detonatable primer 50 will thermally degrade due to long exposure to high temperatures is substantially eliminated.

Figure 2:
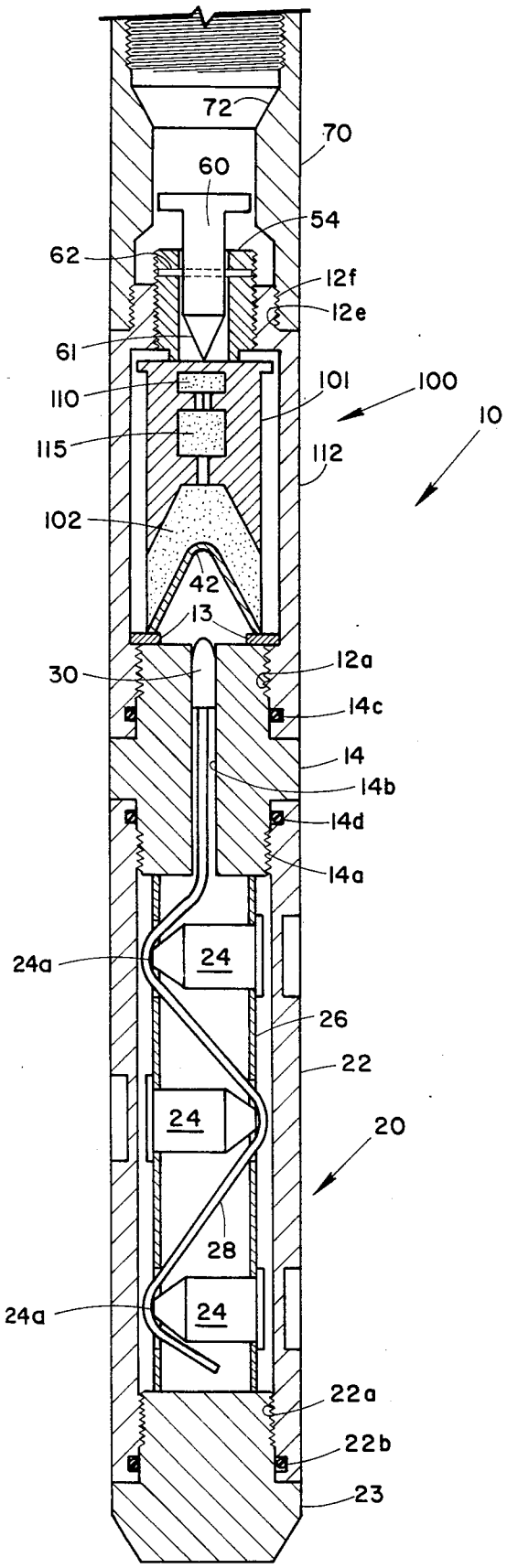
FIG. 2 is a view similar to FIG. 1, but showing an alternative embodiment.

Referring to FIG. 2, there is shown an alternative embodiment of this invention. Similar numbers in FIG. 2 indicate parts identical to those previously described in connection with FIG. 1.

In FIG. 2, the downwardly directed shaped charge and the impact actuated primer therefor are combined into a single unit, indicated by the numeral 100. This combined unit comprises a shell or casing 101 within which is mounted a conventional downwardly directed shaped charge 102. An impact actuated primer 110 is positioned adjacent the upper thin walled end portion of the casing 101 and is in direct communication with a mass of lead azide or any other primary explosive 115. The primary explosive 115 is in turn in direct communication with the shaped charge 102. The concave end of the shell 101 is defined by a metal wall 42.

The composite shaped charge-primer is positioned within the firing head housing 112 which has its internal bore modified to accommodate the combination shaped charge-primer 100. The hammer 60 is mounted in the upper end of the housing 112 in the same manner as described in FIG. 1, and is driven downwardly by the impact forces generated by the dropping of a detonating bar thereon. The pointed end of 61 of hammer 60 impinges upon the top end portion 101*a* of the casing 101 and effects the detonation of the primer charge 110 positioned immediately adjacent such top end.

In this embodiment, as in the embodiment FIG. 1, the principle of firing the high temperature resistant booster charge 30 or the primer cord 28 remains the same. The energy developed by a downwardly directed shaped change 102 is employed to effect the high energy detonation of these elements.

Although the invention has been described in terms of specified embodiments which are set forth in detail, it should be understood that this is by illustration only and that the invention is not necessarily limited thereto, since alternatives will become apparent to those skilled in the art in view of the disclosure. Accordingly, modifications are contemplated which can be made without departing from the spirit of the described invention.

What is claimed and desired to be secured by Letters Patent is:

1. A method of firing a well perforating gun in a well environment of about 400° F., said gun containing a plurality of vertically spaced, shaped charges formed of thermal resistant explosive material, comprising the steps of: running a primer cord of thermal resistant explosive material adjacent the detonating ends of the thermal resistant shaped charges; disposing a downwardly directed shaped charge formed of thermal resistant explosive material immediately above the top end of the primer cord; mounting an impact detonatable flyer plate primer immediately above the downwardly directed shaped charge; and detonating said primer to fire said downwardly directed shaped charge by said flyer plate, thereby detonating said primer cord and all of said thermal resistant shaped charges.

2. The method of claim 1 further comprising inserting a booster charge of thermal resistant explosive material between the top end of said primer cord and said downwardly directed shaped charge.

3. The method of claim 1 wherein said thermal resistant explosive material comprises [2,6-bis(picrylamino)-3,5-dinitropyridine].

4. The method of claim 1 wherein said thermal resistant explosive material comprises hexanitrostilbene.

5. A perforating gun for high-temperature wells comprising carrier means for supporting a plurality of radially directed shaped charges in vertically spaced relation; a primer cord passing upwardly adjacent the detonating end of all said shaped charges; a downwardly directed shaped charge positioned immediately above the top end of said primer cord, all of said shaped charges and said primer cord being formed of thermally resistant explosive material; and an impact detonatable, flying plate primer positioned immediately above and adjacent to said downwardly directed shaped charge, whereby the detonation of said primer detonates said downwardly directed shaped charge and said primer cord at a high level of detonating energy to assure the detonation of said radially directed shaped charges.

6. The perforating gun of claim 5 further comprising a booster charge of thermally resistant explosive material disposed intermediate said downwardly directed shaped charge and the top end of said primer cord.

7. The apparatus of claim 5 wherein said downwardly directed shaped charge, said radially directed shaped charges and said primer cord are formed of a thermally stable explosive material capable of withstanding about 400° F. for more than about 100 hours.

8. The apparatus of claim 7 wherein said thermally stable explosive material comprises hexanitrostilbene.

9. The apparatus of claim 7 wherein said thermally stable explosive material comprises [2,6-bis(picrylamino)-3,5-dinitropyridine].

* * * * *